US007726458B2

(12) United States Patent
Kim

(10) Patent No.: US 7,726,458 B2
(45) **Date of Patent: *Jun. 1, 2010**

(54) STRUCTURE FOR MAINTAINING GAP OF PAPER MONEY DISCRIMINATING APPARATUS

(75) Inventor: Jun Young Kim, Anyang-Si (KR)

(73) Assignee: Nautilus Hyosung, Inc., Seoul (KR)

( * ) Notice: Subject to any disclaimer, the term of this patent is extended or adjusted under 35 U.S.C. 154(b) by 17 days.

This patent is subject to a terminal disclaimer.

(21) Appl. No.: 11/824,123

(22) Filed: Jun. 29, 2007

(65) Prior Publication Data

US 2008/0006507 A1 Jan. 10, 2008

(30) Foreign Application Priority Data

Jun. 30, 2006 (KR) ..... 10-2006-0060593

(51) Int. Cl.
*G07D 11/00* (2006.01)
*G07D 13/00* (2006.01)

(52) U.S. Cl. ..... 194/350; 194/344

(58) Field of Classification Search ..... 195/350; 194/206, 350

See application file for complete search history.

(56) References Cited

U.S. PATENT DOCUMENTS 3,227,256 A * 1/1966 Schepllin ..... 194/203
5,462,150 A * 10/1995 Chang ..... 194/206
5,720,376 A 2/1998 Polidoro et al.
5,806,650 A * 9/1998 Mennie et al. ..... 194/206
7,178,800 B2 2/2007 Stauber
7,422,095 B2 9/2008 Yoshioka
2003/0217906 A1 * 11/2003 Baudat et al. ..... 194/207

OTHER PUBLICATIONS

U.S. Office Action for U.S. Appl. No. 11/823,920, dated Nov. 28, 2008.

* cited by examiner

*Primary Examiner*—Patrick Mackey
*Assistant Examiner*—Mark Beauchaine
(74) *Attorney, Agent, or Firm*—Lahive & Cockfield, LLP; Thomas V. Smurzynski; Anthony A. Laurentano

(57) ABSTRACT

A structure maintains a gap in a paper money discriminating apparatus that may be provided in an automatic teller machine. The structure may include a paper money discriminating sensor that is provided in an upper body to discriminate whether a paper money to be conveyed along a conveyance path is counterfeit money, a lower body that is provided so as to face the paper money discriminating sensor with a predetermined gap therebetween, and spacing protrusions that protrude upward from an upper surface of the lower body and come in contact with both end portions of the paper money discriminating sensor so as to maintain a constant gap between a lower surface of the paper money discriminating sensor and the upper surface of the lower body.

9 Claims, 5 Drawing Sheets

STRUCTURE FOR MAINTAINING GAP OF PAPER MONEY DISCRIMINATING APPARATUS

RELATED APPLICATION

The present application claims convention priority to, and the benefit of, Korean patent application No. 10-2006-0060593 filed on Jun. 30, 2006, the content of which incorporated by reference.

BACKGROUND OF THE INVENTION

1. Field of the Invention

The present invention relates to a structure for a paper money discriminating apparatus that is provided, for example, in an ATM (automatic teller machine), and more particularly, to a structure for maintaining a constant gap between a paper money discriminating sensor (which is provided to discriminate whether paper money to be conveyed along a conveyance path is counterfeit money) and a paper money conveying surface in the paper money discriminating apparatus.

2. Description of the Related Art

In general, a cash dispenser unit (CDU) and a billing recycling machine (BRM) have been used as automatic teller machines that quickly and conveniently provide various financial services at anytime without consulting with a person. The CDU has been used since the financial services have been computerized, and is used to withdraw only cash. The BRM has a deposit function in addition to a cash dispensing function.

FIG. 1 is a schematic view showing a structure of a conventional ATM (automatic teller machine).

An automatic teller machine includes a deposit/withdrawal unit 10 into/from which a client puts or withdraws paper money, a conveyance path 20 on which the paper money to be put into or withdrawn from the deposit/withdrawal unit 10 are transferred, a paper money discriminating unit 30 that is provided on the conveyance path 20 and discriminates paper moneys, a temporary storing unit 40 in which paper moneys deposited through the paper money discriminating unit 30 are temporarily loaded, and a plurality of recycle boxes 50 in which paper moneys deposited by a client are loaded and withdrawn to be circulated.

The paper money discriminating unit 30 includes a paper money discriminating sensor, such as an image sensor that detects various images formed on the surface of paper money in order to discriminate the kind of paper money and a magnetic sensor that senses magnetic ingredients of the paper money.

When a gap between the sensor and the paper money is a specific distance, a sensor characteristic curve is formed so that the above-mentioned paper money discriminating sensor has the best sensitivity. Further, if the gap between the sensor and the paper money is smaller or larger than the specific distance, the sensitivity of the sensor deteriorates, such that it is not possible to accurately discriminate paper money.

For this reason, a constant gap should be maintained between the paper money discriminating sensor and the paper money conveying surface formed under the sensor.

When a bracket and fasteners are used to fix the paper money discriminating sensor, manufacturing tolerance and assembly tolerance of parts are caused. Accordingly, it is difficult to accurately maintain a desired gap.

SUMMARY OF THE INVENTION

An object of the invention is to provide a structure for maintaining a constant gap between a lower surface of a paper money discriminating sensor provided in an upper body and an upper surface of a lower body serving as a paper money conveying surface regardless of manufacturing tolerance and assembly tolerance of parts so as to accurately discriminate paper money in a paper money discriminating apparatus.

According to an aspect of the invention, a structure for maintaining a gap in a paper money discriminating apparatus includes a paper money discriminating sensor that is provided in an upper body to discriminate whether paper money to be conveyed along a conveyance path is counterfeit money, a lower body that is provided so as to face the paper money discriminating sensor with a predetermined gap therebetween, and spacing protrusions that protrude upward from an upper surface of the lower body and contact both end portions of the paper money discriminating sensor so as to maintain a constant gap between a lower surface of the paper money discriminating sensor and the upper surface of the lower body.

In this case, the paper money discriminating sensor may be fixed to fixing brackets and provided on the upper body. Further, spacing springs may be provided on an upper surface of the fixing bracket so that elastic force is applied downwardly and both end portions of the paper money discriminating sensor come in contact with upper surfaces of the spacing protrusions.

Furthermore, each of the spacing springs may be formed of a coil spring, and each of spring fasteners may be inserted into a central portion of each of the spacing springs. In addition, each of the spring fasteners may be fastened to each of the bosses, which protrude from the lower body, by a thread.

In this case, the thread may be partially formed at an end portion of the body of each spring fastener.

DESCRIPTION OF THE PREFERRED EMBODIMENTS

Figure 1:
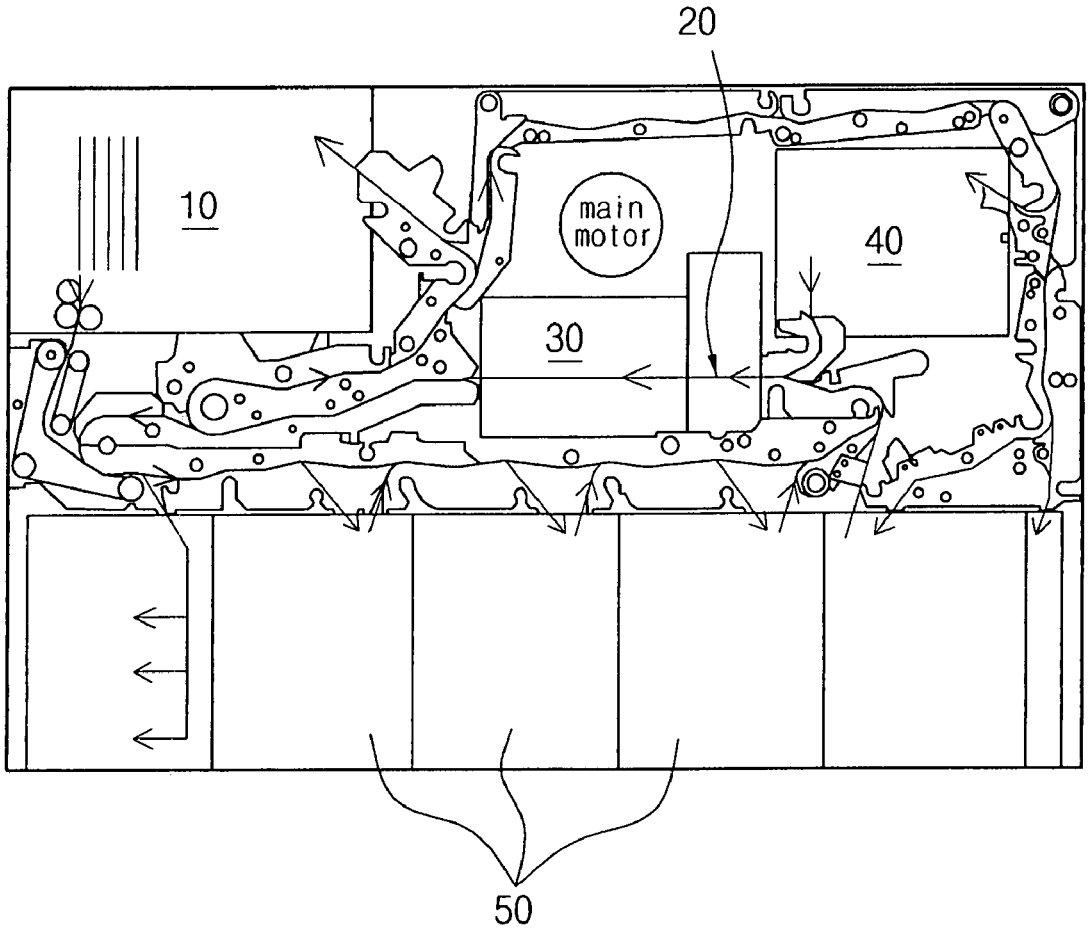
FIG. 1 is a schematic view showing a structure of a conventional ATM (automatic teller machine)

A structure according to a preferred embodiment of the invention and the operation thereof will be described in detail below with reference to accompanying drawings. Elements shown in each drawing are indicated by reference numerals in this specification. Although shown in different drawings, it should be noted that the same elements are indicated by the same reference numerals if possible.

Figure 2:
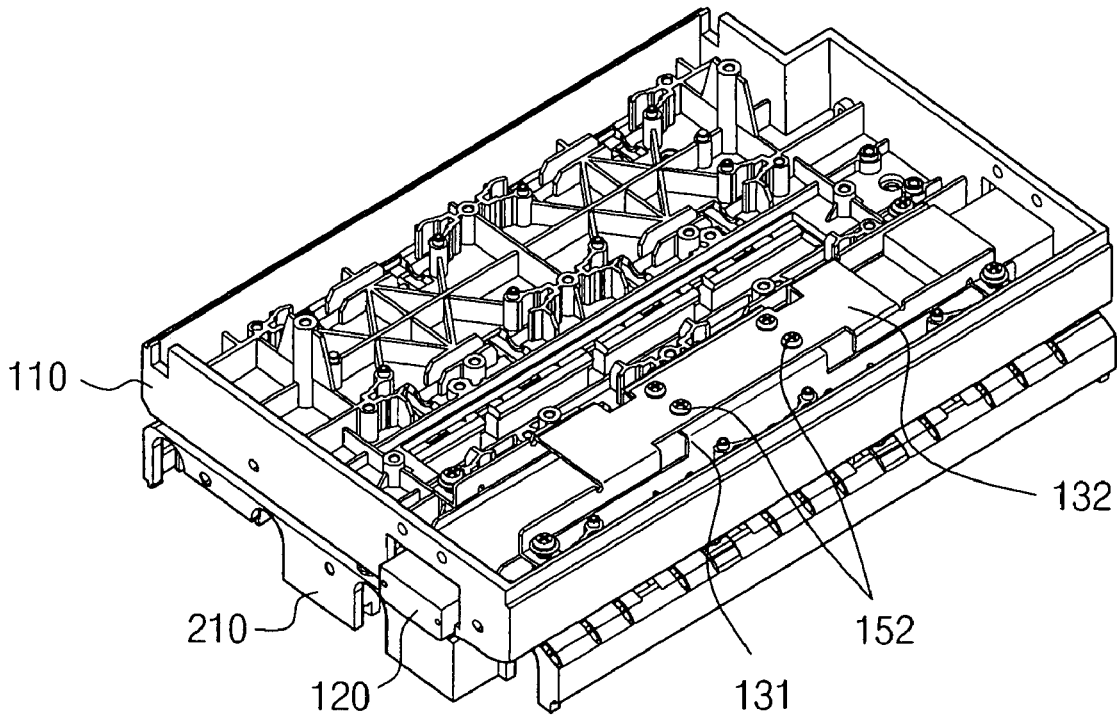
FIG. 2 is a perspective view of a paper money discriminating apparatus to which the structure for maintaining a gap between a paper money discriminating sensor and a paper money conveying surface according to an embodiment of the invention is applied.
Figure 3:
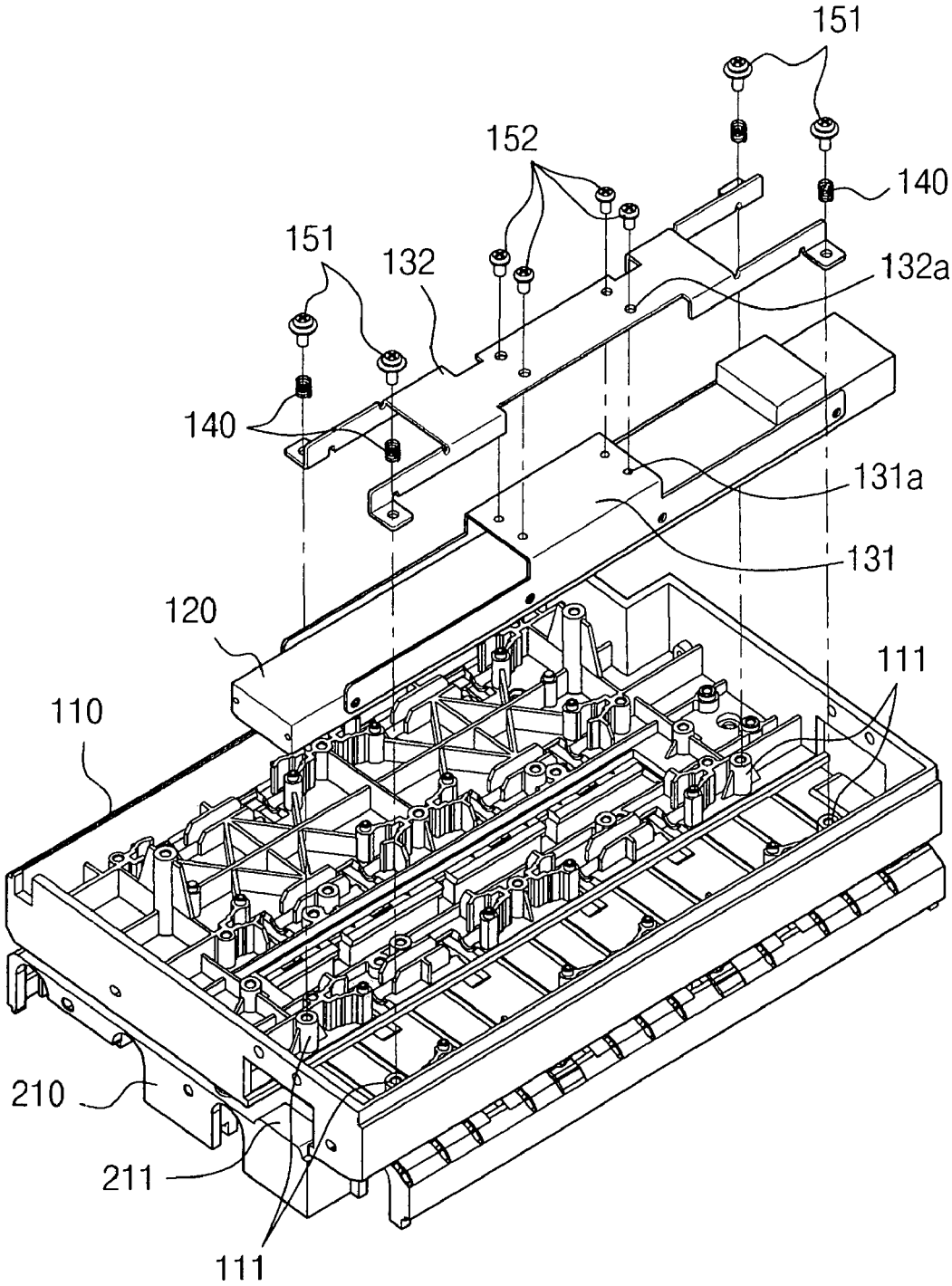
FIG. 3 is an exploded perspective view of the paper money discriminating apparatus according to the embodiment of the invention.

FIG. 2 is a perspective view of a paper money discriminating apparatus to which the structure for maintaining a gap between a paper money discriminating sensor and a paper money conveying surface according to an embodiment of the invention is applied. FIG. 3 is an exploded perspective view of the paper money discriminating apparatus shown in FIG. 2.

Figure 4:
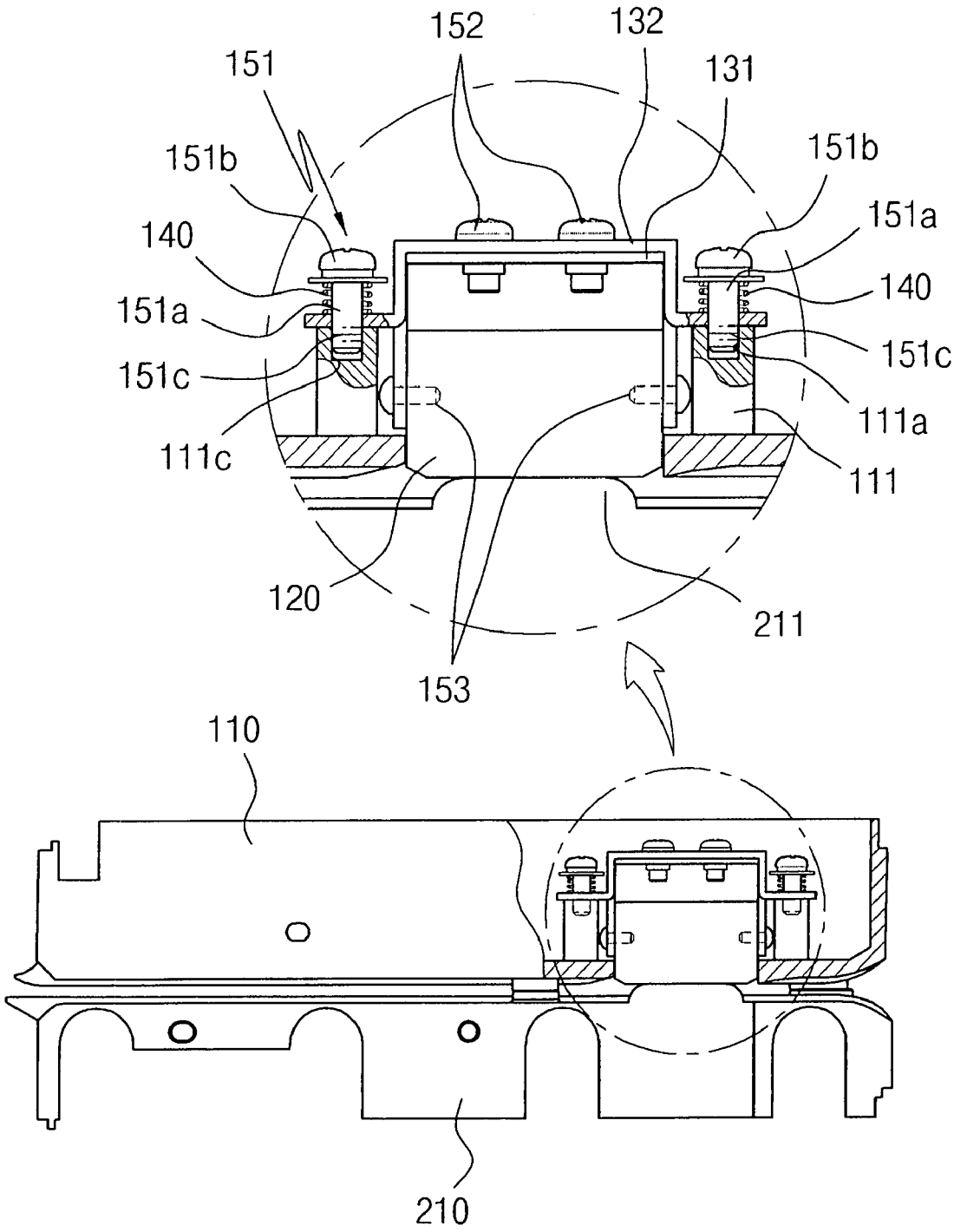
FIGS. 4 and 5 are cross-sectional views of the paper money discriminating apparatus shown in FIG. 2.
Figure 5:
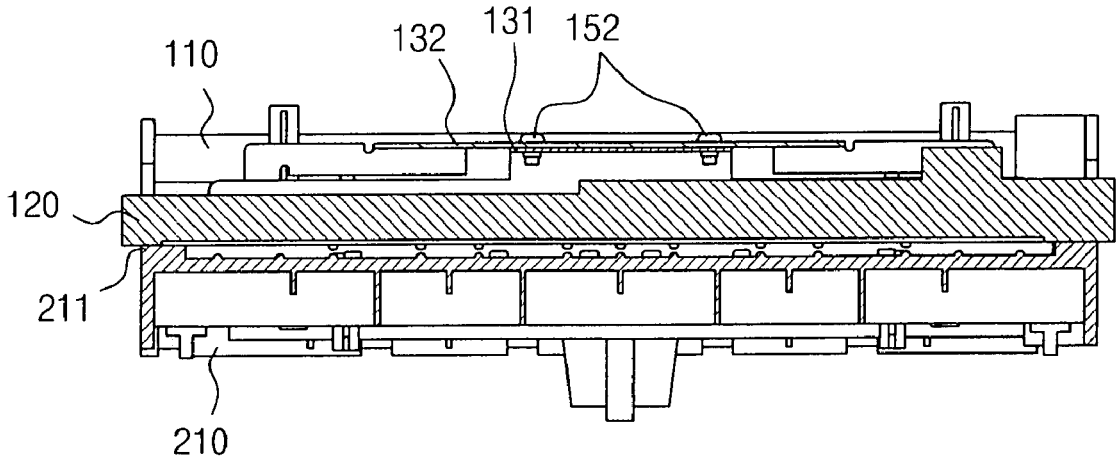

FIGS. 4 and 5 are cross-sectional views of the paper money discriminating apparatus shown in FIG. 2.

The structure for maintaining a gap between a paper money discriminating sensor and a paper money conveying surface according to the embodiment of the invention includes a paper money discriminating sensor 120, a lower body 210, and spacing protrusions 211. The paper money discriminating sensor 120 is provided in an upper body 110 to discriminate whether paper money to be conveyed along a conveyance path 20 is counterfeit money. The lower body 210 is provided below the paper money discriminating sensor 120 with a predetermined gap therebetween so as to face the paper money discriminating sensor 120. The spacing protrusions 211 maintain a predetermined gap between a lower surface of the paper money discriminating sensor 120 and an upper surface of the lower body 210.

An image sensor, which detects various images formed on the surface of paper money in order to discriminate the kind of paper money, may be used as the paper money discriminating sensor 120. For example, when a gap between the sensor and a paper money conveying surface (the upper surface of the lower body) is 2 mm, the image sensor has the best sensitivity.

The spacing protrusions 211 are provided between the paper money discriminating sensor 120 and the paper money conveying surface in order to maintain a constant gap of 2 mm between the paper money discriminating sensor 120 and the paper money conveying surface.

That is, each of the upper body 110 and the lower body 210 is made of a plastic molding, and the spacing protrusions 211 protrude upward from the upper surface of the lower body 210 at both ends of the lower body in a longitudinal direction of the paper money discriminating sensor 120.

Accordingly, a gap of a conveyance path, which is formed between the paper money discriminating sensor 120 and the upper surface of the lower body 210 so as to convey the paper money, is changed depending on the height of the spacing protrusions 211. For this reason, if only the height of the spacing protrusions 211 is managed regardless of assembly tolerance of other parts, it is possible to accurately maintain the gap of the conveyance path.

Therefore, it is possible to maintain an accurate gap regardless of manufacturing tolerance and assembly tolerance of a bracket, which is used to fix the spacing protrusions 211.

The spacing protrusions 211 have been integrally formed with the lower body 210 in this embodiment. However, the spacing protrusions are formed to be separated from the lower body 210, and may be combined with the lower body.

Meanwhile, the paper money discriminating sensor 120 is preferably provided in the upper body 110 so that a downward elastic force is applied to the paper money discriminating sensor 120. Specifically, the paper money discriminating sensor 120 is fixed to fixing brackets 131 and 132, and provided on the upper body 110. Spacing springs 140 are provided on the upper surface of the fixing brackets 131 and 132 so that elastic force is applied downwardly, and both end portions of the paper money discriminating sensor 120 come in contact with the upper surfaces of the spacing protrusions 211.

The fixing brackets 131 and 132 are composed of a first fixing bracket 131 and a second fixing bracket 132. The first fixing bracket 131 is fixed to the side surfaces of the paper money discriminating sensor 120 by sensor fasteners 153, and has fastening holes 131*a* on the upper surface thereof. Further, the second fixing bracket 132 has fastening holes 132*a* on the upper surface thereof, and is fixed to the first fixing bracket 131 by bracket fasteners 152 that pass through the fastening holes 131*a* and fastening holes 132*a*.

The second fixing bracket 132 is fixed to bosses 111, which protrude from the upper body 110, by four spring fasteners 151. A thread 111*a* is formed on the inner surface of each of the bosses 111.

Meanwhile, each of the spacing springs 140 is formed of a coil spring, and each of the spring fasteners 151 is inserted into the central portion of each of the spacing springs 140. Further, a body 151*a* of each of the spring fasteners 151 is fastened to each of the bosses 111 by the thread 111*a*, and the spacing springs 140 are elastically provided between the upper surface of the second fixing bracket 132 and heads 151*b* of the spring fasteners 151.

Accordingly, the downward elastic force of the spacing springs 140 are applied to the second fixing bracket 132. For this reason, the lower surface of the paper money discriminating sensor 120 always comes in contact with the spacing protrusions 211, and is elastically supported by the spacing springs 140. Therefore, even though the height of the spacing protrusion 211 is changed, it is possible to mount the paper money discriminating sensor so as to correspond to the change in height of the spacing protrusion.

In this case, if a thread 151*c* is partially formed at a lower end portion of the body 151*a* of each spring fastener 151, it is possible to control an insertion depth of the spring fastener into the boss 111 when each of the spring fasteners 151 is fastened to the boss 111 by the thread 111*a*.

As described in detail above, in the structure for maintaining a gap of a paper money discriminating apparatus according to the embodiment of the invention, the spacing protrusions are formed on the lower body in order to maintain a constant gap between the lower surface of the paper money discriminating sensor and the upper surface of the lower body. For this reason, it is possible to maintain a constant gap between the lower surface of the paper money discriminating sensor and the upper surface of the lower body regardless of manufacturing tolerance and assembly tolerance of parts. Therefore, it is possible to accurately discriminate paper money.

What is claimed is:

1. A structure for maintaining a gap in a paper money discriminating apparatus, the structure comprising:

a paper money discriminating sensor that is provided in an upper body, across a width of a paper money conveyed, to discriminate whether a paper money to be conveyed along a conveyance path is counterfeit money;

a lower body that is provided so as to face the paper money discriminating sensor with a predetermined gap therebetween; and spacing protrusions that protrude upward from both end portions of an upper surface of the lower body and directly come in contact with both end portions of the paper money discriminating sensor so as to maintain a constant gap between a lower surface of the paper money discriminating sensor and the upper surface of the lower body, the upper surface of the lower body forming a paper money conveying surface;

wherein a paper money is conveyed through the constant gap formed by the lower surface of the paper money discriminating sensor, the spacing protrusions, and the upper surface of the lower body.

2. The structure according to claim 1, wherein the paper money discriminating sensor is fixed to fixing brackets and provided on the upper body, and spacing springs are provided on an upper surface of the fixing bracket so that an elastic force of the spacing springs is applied downwardly so as to maintain both end portions of the lower surface of the paper money discriminating sensor in contact with upper surfaces of the spacing protrusions when the conveyance path is closed.

3. The structure according to claim 2, wherein each of the spacing springs is formed of a coil spring, each of spring fasteners is inserted into a central portion of each of the spacing springs, and each of the spring fasteners is fastened to each of bosses, which protrude from the lower body, by a threaded connection.

4. The structure according to claim 3, wherein a thread is partially formed at an end portion of each spring fastener.

5. A paper money discriminating apparatus comprising:

an upper body and a lower body forming a conveyance path for conveying paper money therebetween;

a paper money discriminating sensor provided in the upper body, across a width of a paper money conveyed, to discriminate whether paper money conveyed along the conveyance path is counterfeit money, wherein the lower body faces the paper money discriminating sensor with a predetermined gap therebetween; and spacing protrusions that protrude upward from both end portions of an upper surface of the lower body and directly come in contact with both end portions of the paper money discriminating sensor so as to maintain a constant gap between the lower surface of the paper money discriminating sensor and the upper surface of the lower body, the upper surface of the lower body forming a paper money conveying surface;

wherein a paper money is conveyed through the constant gap formed by the lower surface of the paper money discriminating sensor, the spacing protrusions, and the upper surface of the lower body.

6. The apparatus according to claim 5, wherein the spacing protrusions are integrally formed with the lower body.

7. The apparatus according to claim 5, wherein the spacing protrusions are separately formed from the lower body.

8. The apparatus according to claim 5, further comprising:

a fixing bracket to which the paper money discriminating sensor is fixed.

9. The apparatus according to claim 8, further comprising:

spacing springs provided on an upper surface of the fixing bracket to apply an elastic force to the fixing bracket downwardly so as to maintain both end portions of the lower surface of the paper money discriminating sensor in contact with upper surfaces of the spacing protrusions when the conveyance path is closed.

* * * * *